US009719029B2

(12) United States Patent
Koseoglu et al.

(10) Patent No.: US 9,719,029 B2
(45) Date of Patent: Aug. 1, 2017

(54) OXIDATIVE DESULFURIZATION PROCESS AND SYSTEM USING GASEOUS OXIDANT-ENHANCED FEED

(71) Applicant: Saudi Arabian Oil Company, Dhahran (SA)

(72) Inventors: Omer Refa Koseoglu, Dhahran (SA); Abdennour Bourane, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/076,329

(22) Filed: Nov. 11, 2013

(65) Prior Publication Data

US 2014/0131255 A1 May 15, 2014

Related U.S. Application Data

(60) Provisional application No. 61/724,672, filed on Nov. 9, 2012.

(51) Int. Cl.
*C10G 27/04* (2006.01)
*C10G 27/12* (2006.01)

(52) U.S. Cl.
CPC ..... *C10G 27/04* (2013.01); *C10G 27/12* (2013.01); *C10G 2300/202* (2013.01)

(58) Field of Classification Search
CPC ..... C10G 27/04; C10G 27/12; C10G 27/14; C10G 2300/4037; C10G 27/00; C10G 27/06; C10G 27/08; C10G 27/10
USPC ..... 208/196, 204, 208 R, 240
See application file for complete search history.

(56) References Cited

U.S. PATENT DOCUMENTS 2,504,429 A † 4/1950 Latchum, Jr.
2,749,284 A 6/1956 Noble
2,893,951 A * 7/1959 Pieters et al. ..... 208/204
3,062,736 A * 11/1962 Bally et al. ..... 208/205
(Continued)

FOREIGN PATENT DOCUMENTS

WO 9856875 A1 12/1998
WO 0218518 A1 3/2002
(Continued)

OTHER PUBLICATIONS

PCT/US2013/0069353, International Search Report and Written Opinion dated Feb. 13, 2014, 10 pages.
(Continued)

*Primary Examiner* — Prem C Singh
*Assistant Examiner* — Brandi M Doyle
(74) *Attorney, Agent, or Firm* — Abelman, Frayne & Schwab

(57) ABSTRACT

An oxidative desulfurization process is provided in which gaseous oxidant required for oxidative desulfurization reactions is dissolved in the feedstock upstream of the oxidative desulfurization reactor. Gaseous oxidant is mixed with a generally liquid phase feedstock (and in certain embodiment peroxide precursors are also mixed) in a mixing zone under conditions effective to dissolve the gaseous oxidant in the liquid feedstock. The gaseous oxidant dissolved in the hydrocarbon feedstock provides a gaseous oxidant-enhanced feedstock which is charged to the oxidative desulfurization reaction zone thereby permitting substantially liquid phase operation.

20 Claims, 4 Drawing Sheets

(56) References Cited

U.S. PATENT DOCUMENTS

| | | | | |
|---|---|---|---|---|
| 3,341,448 | A | 9/1967 | Ford et al. | |
| 3,767,563 | A | 10/1973 | Woodle | |
| 3,847,800 | A | 11/1974 | Guth et al. | |
| 3,919,402 | A * | 11/1975 | Guth et al. | 423/522 |
| 4,830,733 | A | 5/1989 | Nagji et al. | |
| 4,875,997 | A * | 10/1989 | Langford | 208/235 |
| 5,730,860 | A | 3/1998 | Irvine | |
| 5,753,102 | A | 5/1998 | Funakoshi et al. | |
| 5,824,207 | A | 10/1998 | Lyapin et al. | |
| 5,910,440 | A | 6/1999 | Grossman et al. | |
| 6,087,544 | A | 7/2000 | Wittenbrink et al. | |
| 6,171,478 | B1 | 1/2001 | Cabrera et al. | |
| 6,277,271 | B1 | 8/2001 | Kocal | |
| 7,291,257 | B2 | 11/2007 | Ackerson et al. | |
| 7,297,253 | B1 * | 11/2007 | Gosling | C10G 27/12 208/196 |
| 2004/0200757 | A9 * | 10/2004 | Takewaki et al. | 208/111.01 |
| 2006/0108263 | A1 | 5/2006 | Lin | |
| 2008/0308463 | A1 † | 12/2008 | Keckler et al. | |
| 2009/0065400 | A1 * | 3/2009 | Song et al. | 208/243 |
| 2011/0233110 | A1 | 9/2011 | Koseoglu | |

FOREIGN PATENT DOCUMENTS

| | | | |
|---|---|---|---|
| WO | 03014266 | A1 | 2/2003 |
| WO | 2006071793 | A1 | 7/2006 |

OTHER PUBLICATIONS

Ruixiang Hua et al., "Determination of sulfur-containing compounds in diesel oils by comprehensive two-dimensional gas chromatography with a sulfur chemiluminescence detector." Journal of Chromatography, vol. 1019, Issues 1-2, Nov. 2003, 101-109.

Petr Steiner et al., "Catalytic hydrodesulfurization of a light gas oil over a NiMo catalyst: kinetics of selected sulfur components." Fuel Processing Technology, vol. 79, Issue 1, Aug. 2, 2002, 1-12.

* cited by examiner
† cited by third party

OXIDATIVE DESULFURIZATION PROCESS AND SYSTEM USING GASEOUS OXIDANT-ENHANCED FEED

RELATED APPLICATIONS

This application claims the benefit of priority of U.S. Provisional Patent Application Nos. 61/724,672 filed Nov. 9, 2012, which is incorporated by reference herein.

BACKGROUND OF THE INVENTION

Field of the Invention

This invention relates to oxidative desulfurization of hydrocarbons mixtures.

Description of Related Art

The discharge into the atmosphere of sulfur compounds during processing and end-use of the petroleum products derived from sulfur-containing sour crude oil pose health and environmental problems. The stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries for transportation fuel have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with an ultra-low sulfur level.

To keep pace with recent trends toward production of ultra-low sulfur fuels, refiners must choose among the processes or crude oils that provide flexibility that ensures future specifications are met with minimum additional capital investment, in many instances by utilizing existing equipment. Technologies such as hydrocracking and two-stage hydrotreating offer solutions to refiners for the production of clean transportation fuels. These technologies are available and can be applied as new grassroots production facilities are constructed.

There are many hydrotreating units installed worldwide producing transportation fuels containing 500-3000 ppmw sulfur. These units were designed for, and are being operated at, relatively milder conditions (i.e., low hydrogen partial pressures of 30 kilograms per square centimeter for straight run gas oils boiling in the range of 180° C.-370° C.). Retrofitting is typically required to upgrade these existing facilities to meet the more stringent environmental sulfur specifications in transportation fuels mentioned above. However, because of the comparatively more severe operational requirements (i.e., higher temperature and pressure) to obtain clean fuel production, retrofitting can be substantial. Retrofitting can include one or more of integration of new reactors, incorporation of gas purification systems to increase the hydrogen partial pressure, reengineering the internal configuration and components of reactors, utilization of more active catalyst compositions, installation of improved reactor components to enhance liquid-solid contact, the increase of reactor volume, and the increase of the feedstock quality.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene. Aromatic sulfur-containing molecules have a higher boiling point than aliphatic sulfur-containing molecules, and are consequently more abundant in higher boiling fractions.

In addition, certain fractions of gas oils possess different properties. The following table illustrates the properties of light and heavy gas oils derived from Arabian Light crude oil:

TABLE 1

| Feedstock Name | | Light | Heavy |
|---|---|---|---|
| Blending Ratio | | — | — |
| API Gravity | ° | 37.5 | 30.5 |
| Carbon | W % | 85.99 | 85.89 |
| Hydrogen | W % | 13.07 | 12.62 |
| Sulfur | W % | 0.95 | 1.65 |
| Nitrogen | ppmw | 42 | 225 |
| ASTM D86 Distillation | | | |
| IBP/5 V % | ° C. | 189/228 | 147/244 |
| 10/30 V % | ° C. | 232/258 | 276/321 |
| 50/70 V % | ° C. | 276/296 | 349/373 |
| 85/90 V % | ° C. | 319/330 | 392/398 |
| 95 V % | ° C. | 347 | |
| Sulfur Speciation | | | |
| Organosulfur Compounds Boiling Less than 310° C. | ppmw | 4591 | 3923 |
| Dibenzothiophenes | ppmw | 1041 | 2256 |
| $C_1$- Dibenzothiophenes | ppmw | 1441 | 2239 |
| $C_2$- Dibenzothiophenes | ppmw | 1325 | 2712 |
| $C_3$- Dibenzothiophenes | ppmw | 1104 | 5370 |

As set forth above in Table 1, the light and heavy gas oil fractions have ASTM (American Society for Testing and Materials) D86 90V % point of 319° C. and 392° C., respectively. Further, the light gas oil fraction contains less sulfur and nitrogen than the heavy gas oil fraction (0.95 W % sulfur as compared to 1.65 W % sulfur and 42 ppmw nitrogen as compared to 225 ppmw nitrogen).

It is known that middle distillate cut boiling in the range of 170° C.-400° C. contains sulfur species including thiols, sulfides, disulfides, thiophenes, benzothiophenes, dibenzothiophenes, and benzonaphthothiophenes, with and without alkyl substituents. (Hua, et al., "Determination of Sulfur-containing Compounds in Diesel Oils by Comprehensive Two-Dimensional Gas Chromatography with a Sulfur Chemiluminescence Detector," *Journal of Chromatography A,* 1019 (2003) pp. 101-109).

The sulfur specification and content of light and heavy gas oils are conventionally analyzed by two methods. In the first method, sulfur species are categorized based on structural groups. The structural groups include one group having sulfur-containing compounds boiling at less than 310° C., including dibenzothiophenes and its alkylated isomers, and another group including 1, 2 and 3 methyl-substituted dibenzothiophenes, denoted as $C_1$, $C_2$ and $C_3$, respectively. Based on this method, the heavy gas oil fraction contains more alkylated di-benzothiophene molecules than the light gas oils.

In the second method of analyzing sulfur content of light and heavy gas oils, the cumulative sulfur concentrations are plotted against the boiling points of the sulfur-containing compounds to observe concentration variations and trends. The heavy gas oil fraction contains a higher content of heavier sulfur-containing compounds and lower content of lighter sulfur-containing compounds as compared to the light gas oil fraction. For example, it is found that 5370 ppmw of $C_3$-dibenzothiophene, and bulkier molecules such as benzonaphthothiophenes, are present in the heavy gas oil fraction, compared to 1104 ppmw in the light gas oil fraction. In contrast, the light gas oil fraction contains a higher content of light sulfur-containing compounds compared to heavy gas oil. Light sulfur-containing compounds are structurally less bulky than dibenzothiophenes and boil at less than 310° C. Also, twice as much $C_1$ and $C_2$ alkyl-substituted dibenzothiophenes exist in the heavy gas oil fraction as compared to the light gas oil fraction.

Aliphatic sulfur-containing compounds are more easily desulfurized (labile) using conventional hydrodesulfurization methods. However, certain highly branched aliphatic molecules can hinder the sulfur atom removal and are moderately more difficult to desulfurize (refractory) using conventional hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Relative reactivities of sulfur-containing compounds based on their first order reaction rates at 250° C. and 300° C. and 40.7 Kg/cm$^2$ hydrogen partial pressure over Ni—Mo/alumina catalyst, and activation energies, are given in Table 2 (Steiner P. and Blekkan E. A., "Catalytic Hydrodesulfurization of a Light Gas Oil over a Nimo Catalyst: Kinetics of Selected Sulfur Components," *Fuel Processing Technology,* 79 (2002) pp. 1-12).

TABLE 2

| | Name<br>Structure | | |
|---|---|---|---|
| | Dibenzothiophene | 4-methyl-dibenzo-thiophene | 4,6-dimethyl-dibenzo-thiophene |
| | 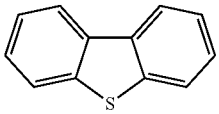 | 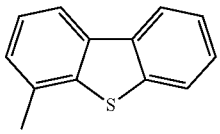 | 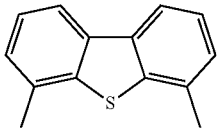 |
| Reactivity $k_{@250}$, $s^{-1}$ | 57.7 | 10.4 | 1.0 |
| Reactivity $k_{@300}$, $s^{-1}$ | 7.3 | 2.5 | 1.0 |
| Activation Energy $E_a$, Kcal/mol | 28.7 | 36.1 | 53.0 |

As is apparent from Table 2, dibenzothiophene is 57 times more reactive than the refractory 4,6-dimethyldibenzothiphene at 250° C. The relative reactivity decreases with increasing operating severity. With a 50° C. temperature increase, the relative reactivity of di-benzothiophene compared to 4,6-dibenzothiophene decreases to 7.3 from 57.7.

The development of non-catalytic processes for desulfurization of petroleum distillate feedstocks has been widely studied, and certain conventional approaches are based on oxidation of sulfur-containing compounds are described, e.g., in U.S. Pat. Nos. 5,910,440; 5,824,207; 5,753,102; 3,341,448 and 2,749,284.

In general, in oxidation desulfurization processes, certain sulfur-containing hydrocarbons are converted under very mild conditions to compounds containing sulfur and oxygen, such as sulfoxides or sulfones for example, which have different chemical and physical properties which make it possible to remove the sulfur-bearing compounds from the balance of the original hydrocarbon stream. Techniques for the removal of oxidized sulfur compounds can include extraction, distillation and adsorption.

Oxidation of heteroatom containing fossil fuel fractions is well known art. The oxidation reactions are either carried-out with the use of liquid peroxides such as hydrogen peroxides, t-butyl-peroxides or other organic peroxides or gaseous oxidants such as air or oxygen or oxides of nitrogen. Liquid phase oxidation reactions can be single-phase (homogeneous catalysts) or two-phase liquid phase systems (heterogeneous catalysts). The gas phase oxidation reactions are reported to take place in three phase reactors where gas (oxidant) liquid (reactants) and solid (catalyst) phases are present. Gas phase systems require comparatively larger reactors and the use of recycle gas compressors.

Notwithstanding the continued improvements in oxidative desulfurization processes, a need remains for improved oxidative desulfurization processes that overcome problems associated with conventional gas phase operations.

SUMMARY OF THE INVENTION

The above objects and further advantages are provided by the oxidative desulfurization system and process described herein, in which gaseous oxidant is dissolved in a hydrocarbon feedstock prior to charging to the reactor.

An oxidative desulfurization process provided herein comprises:

a. mixing a hydrocarbon feedstock containing organosulfur compounds and an excess of gaseous oxidant in a mixing zone under predetermined temperature and pressure conditions effective to dissolve a portion of the gaseous oxidant in the hydrocarbon feedstock to produce a gaseous oxidant-enriched hydrocarbon feedstock;

b. flashing light hydrocarbon compounds and undissolved gaseous oxidant from the gaseous oxidant-enriched hydrocarbon feedstock; and c. maintaining the gaseous oxidant-enriched hydrocarbon feedstock under conditions effective to oxidize organosulfur compounds.

Another oxidative desulfurization process provided herein comprises:

a. mixing a hydrocarbon feedstock containing organosulfur compounds, a peroxide precursor, and an excess of gaseous oxidant in a mixing zone under predetermined conditions of temperature and pressure to dissolve a portion of the gaseous oxidant in the hydrocarbon feedstock to produce a gaseous oxidant-enriched hydrocarbon feedstock;

b. flashing light hydrocarbon compounds and undissolved gaseous oxidant from the gaseous oxidant-enriched hydrocarbon feedstock containing peroxide precursor;

c. maintaining the mixture of gaseous oxidant-enriched hydrocarbon feedstock and peroxide precursor under conditions effective to form peroxide oxidant; and d. maintaining the peroxide oxidant formed in step (c) with hydrocarbon feedstock under conditions to oxidize organosulfur compounds.

Other aspects, embodiments, and advantages of the process of the present invention are discussed in detail below. Moreover, it is to be understood that both the foregoing information and the following detailed description are merely illustrative examples of various aspects and embodiments that are intended to provide an overview or framework for understanding the nature and character of the claimed invention. The accompanying drawings provide schematic illustrations of representative process steps to facilitate an understanding of the various aspects and embodiments of the invention. The drawings, together with the remainder of the specification, serve to explain principles and operations of the described and claimed aspects and embodiments of the present invention.

BRIEF DESCRIPTION OF THE DRAWINGS

The invention will be described in further detail below and with reference to the attached drawings in which.

DETAILED DESCRIPTION OF THE INVENTION

In accordance with certain embodiments to the process herein, at least a substantial portion of gaseous oxidant required for oxidative desulfurization reactions is dissolved in the feedstock upstream of the oxidative desulfurization reactor in an oxygen mixing zone and in further embodiments all gaseous oxidant is dissolved in the feedstream.

In accordance with additional embodiments of the process herein, at least a substantial portion of gaseous oxidant used to generate a peroxide oxidant is dissolved in the feedstream upstream of one or more reactors for in-situ peroxide generation and oxidative desulfurization reactions, and in further embodiments all required gaseous oxidant for in-situ peroxide generation is dissolved in the feedstream.

During oxidative desulfurization reactions, organosulfur compounds contained in a feed are selectively converted to corresponding sulfoxides and/or sulfones. The organosulfur compounds are very non-polar molecules compared to their oxidation products sulfones. Accordingly, by selectively oxidizing hetero-aromatic sulfides such as benzothiophenes and dibenzothiophenes typically contained in refinery streams, a higher polarity characteristic is imparted to these hetero-aromatic compounds. The increase of polarity in the sulfur compounds facilitates removal of these compounds, for instance by known or future developed methods such as extraction and/or adsorption. Likewise, the organic nitrogen compounds are oxidized and separated by the same or similar mechanism.

The gaseous oxidant is mixed with a generally liquid phase feedstock (and in certain embodiment peroxide precursors) in a mixing zone under conditions effective to dissolve the gaseous oxidant in the liquid feedstock. The gaseous oxidant dissolved in the hydrocarbon feedstock prior to charging to the reactor permits substantially liquid phase operation. These liquid phase oxidation reactions can be substantially single-phase in embodiments in which homogeneous catalysts are employed, or substantially two-phase (solid-liquid) in embodiments in which heterogeneous catalysts are employed.

Generally, the feedstock is heated to a target reaction zone temperature. The feedstock can be contacted with an oxygen-containing stream prior to, during, and/or after heating.

In certain embodiments the oxidation process using a gaseous oxidant-enhanced feed begins with a preheating step upstream of the mixing zone to elevate the temperature of the gaseous oxidant and/or hydrocarbon feedstream.

Figure 1:
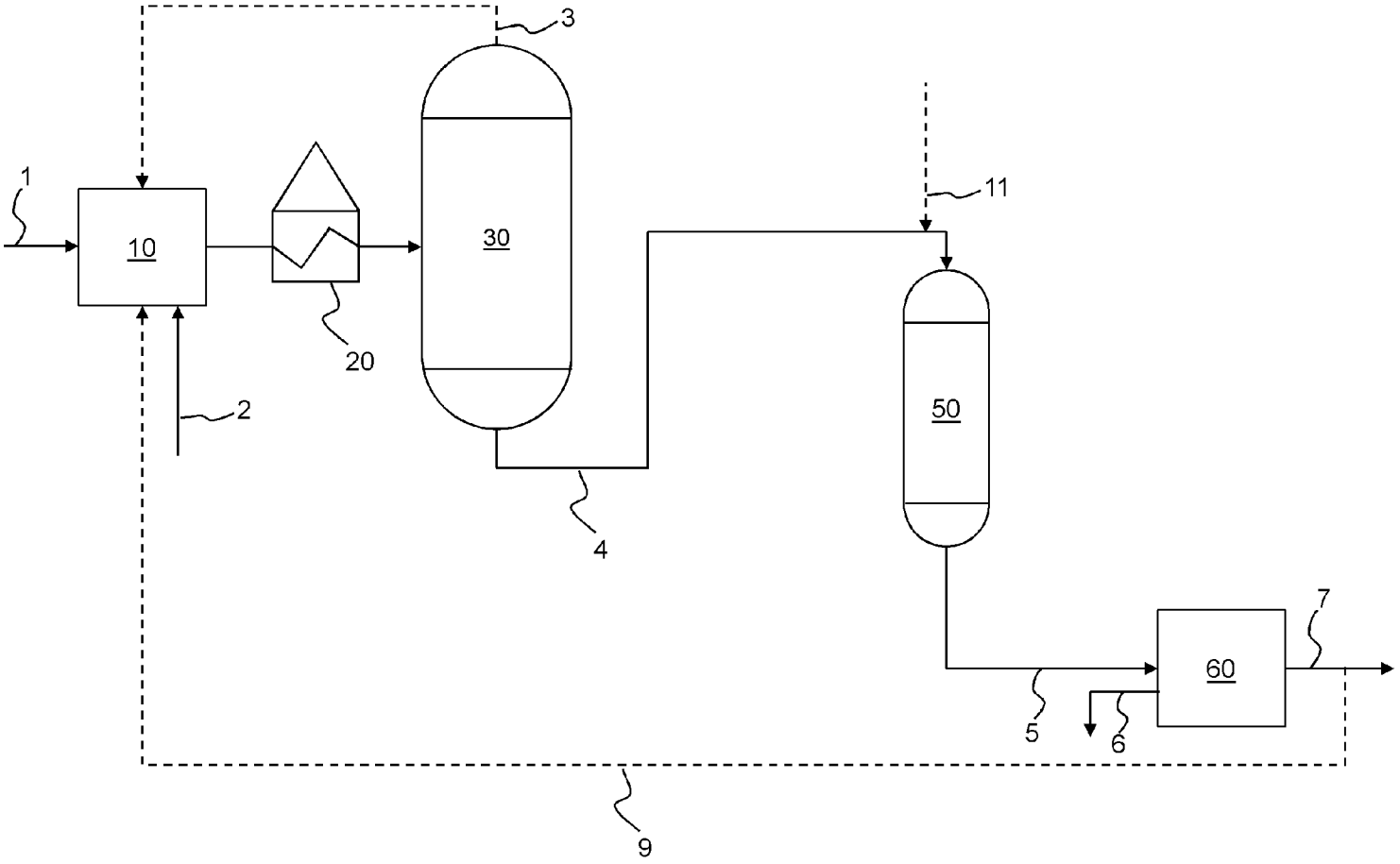
FIG. 1 is a process flow diagram of an embodiment of an oxidative desulfurization process herein.

In one embodiment, an oxidative desulfurization system is shown in FIG. 1 which generally includes a mixing zone 10, a heating zone 20, a flashing zone 30, an oxidation reaction 50 and an oxidation by-product separation zone 60. A feedstock 1 containing undesirable hetero-aromatic sulfides such as benzothiophene and dibenzothiophene and a gaseous oxidant stream 2 are intimately mixed in a mixing zone 10 so as to dissolve at least a portion of the gaseous oxidant in the feedstock, of which a substantial portion is in liquid phase. The mixture is heated in heating zone 20, e.g., one or more furnaces, to the reaction temperature, and the heated mixture is passed to the flashing zone 30, e.g., one or more flash drum vessels. The feedstock and gaseous oxidant can also be separately heated (not shown), in conjunction with heating zone 20 or as a substitute thereto, e.g., in one or more feed/effluent heat exchangers, for instance, to recover heat from the effluent of the oxidation reaction zone. The oxidant-enhanced feedstream 4 containing saturated gaseous oxidant is transferred from the flashing zone 30 as a bottoms stream and is passed to the oxidation reaction zone 50. Excess gas 3, which can include excess oxidant gas and light components of the feedstock, is flashed off in flashing zone 30. All or a portion of stream 3 can optionally (as denoted by dashed lines in FIG. 1) be recycled to mixing zone 10 for mixing with the feedstock. Reactor effluents 5, oxidized products, from oxidation reaction zone 50 are passed to the separation zone 60 to separate an oxidation by-product stream 6 containing sulfoxides and/or sulfones and to recover a desulfurized hydrocarbon stream 7. In certain optional embodiments (as denoted by dashed lines in FIG. 1), for instance, to increase the concentration of the dissolved gaseous oxidant, a portion 9 of the desulfurized hydrocarbon effluent 7 is recycled back to the reactor as a diluent stream. In additional optional embodiments (as denoted by dashed lines in FIG. 1), additional feedstock 11 can be introduced to the oxidative reaction zone 50.

Figure 2:
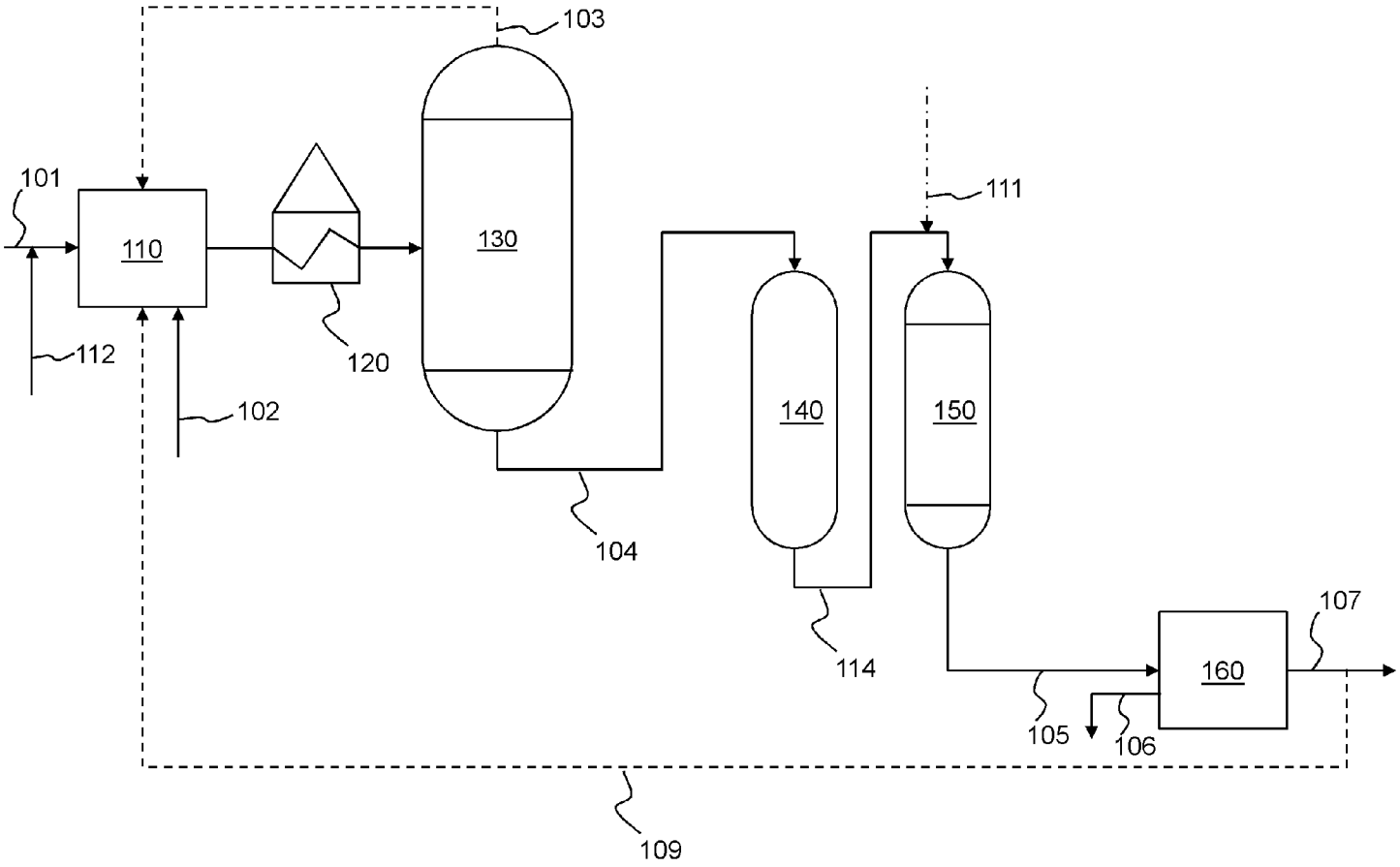
FIG. 2 is a process flow diagram of another embodiment of an oxidative desulfurization process herein.

In another embodiment, an oxidative desulfurization system is shown in FIG. 2 which generally includes a mixing zone 110, a heating zone 120, a flashing zone 130, an in-situ peroxide generation zone 140, an oxidation reaction zone 150 and an oxidation by-product separation zone 160. A feedstock 101 containing undesirable hetero-aromatic sulfides such as benzothiophenes and dibenzothiophenes, a stream 112 containing peroxide precursor compounds and a gaseous oxidant stream 102 are intimately mixed in a mixing zone 110 so as to dissolve at least a portion of the gaseous oxidant in the feedstock and peroxide precursor, of which a substantial portion is in liquid phase. The mixture is heated in heating zone 120, e.g., one or more furnaces, to the reaction temperature, and the heated mixture is passed to the flashing zone 130. The feedstock stream 101, the stream 112 containing peroxide precursor compounds and the gaseous oxidant 102 can also be separately heated (not shown), in conjunction with heating zone 120 or as a substitute thereto, e.g., in one or more feed/effluent heat exchangers, for instance, to recover heat from the effluent of the oxidation reaction zone. The oxidant-enhanced feedstream 104 containing saturated gaseous oxidant and peroxide precursors is transferred from the flashing zone 130 as a bottoms stream and is passed to the in-situ peroxide generation zone 140. Excess gas 103, which can include excess oxidant gas and light components of the feedstock, is flashed off in flashing zone 130. All or a portion of stream 103 can optionally (as denoted by dashed lines in FIG. 2) be recycled to mixing zone 110 for mixing with the feedstock and peroxide precursor. An effluents stream 114 containing peroxides generated in-situ within zone 140 is passed to oxidation reaction zone 150. Reactor effluents 105, oxidized products, from oxidation reaction zone 150 are passed to the separation zone 160 to separate an oxidation by-product stream 106 containing sulfoxides and/or sulfones and to recover a desulfurized hydrocarbon stream 107. In certain optional embodiments (as denoted by dashed lines in FIG. 2), for instance, to increase the concentration of the dissolved gaseous oxidant, a portion 109 of the desulfurized hydrocarbon effluent 107 is recycled back to the reactor as a diluent stream. In additional optional embodiments (as denoted by dashed lines in FIG. 2), additional feedstock 111 can be introduced to the oxidative reaction zone 150.

The in-situ generated organic peroxides are of the general formula R'—OO—R, wherein R represents an organic group containing one aromatic, multi-ring aromatics or naphthenoaromatics substituted with one or several alkyl groups that have exposed tertiary hydrogen readily susceptible to oxidation, and R' is preferably hydrogen.

The mixing zone upstream of the reactor in the embodiments of FIGS. 1 and 2 receives gaseous oxidant, fresh feedstock and, optionally, recycled product that has passed through a reactor. The feed is saturated with gaseous oxidant under predetermined conditions of pressure, temperature and molar ratio to dissolve at least a substantial portion of the requisite gaseous oxidant into the feedstock to produce a combined feed/dissolved gaseous oxidant stream as the reactor influent. Further, residence time of gas and liquid components downstream of the mixing zone, including piping, heater and flash vessel, can promote further interaction between the gas a liquid to dissolve gas in liquid feedstock.

Gas phase oxidant is minimized and eliminated by dissolving at least a substantial portion of the requisite gaseous oxidant in the hydrocarbon feedstock, and flashing the feedstock under predetermined conditions upstream of the reactor to produce a substantially single phase of liquid hydrocarbon feedstock containing dissolved gaseous oxidant as influent to the reactor. In certain embodiment the gaseous oxidant is at or above the saturation level at the selected temperature and pressure.

The specified elevated pressure conditions can be maintained throughout the series of unit operations from the mixing zone through the reaction zone to dissolve and maintain the gas saturated in liquid phase. Flashed gases from the flashing zone can be maintained under the requisite pressure or compressed prior to recycle to the mixing zone. Recycled hydrocarbons (streams 9, 109) and additional hydrocarbon feeds (streams 11, 111) also can be introduced to the mixing zone at the operating pressure of the mixing zone.

For the purpose of this simplified schematic illustrations and description, the numerous valves, pumps, temperature sensors, electronic controllers and the like that are customarily employed in refinery operations and that are well known to those of ordinary skill in the art are not shown.

The gaseous oxidant can comprise molecular oxygen $O_2$, mixtures containing $O_2$ such as air, or other gaseous sources of oxygen suitable as reactant in oxidative desulfurization reactions. In certain embodiments, oxygen depleted air can be used as the gaseous oxidant, i.e., the concentration of oxygen can be less than about 21 vol. %. The oxygen-containing stream generally has an oxygen content of at least 0.01 vol. %. The gases can be supplied from air and optionally in combination with inert diluents such as nitrogen. Other gaseous oxidants can also be used such as oxides of nitrogen.

Figure 3B:
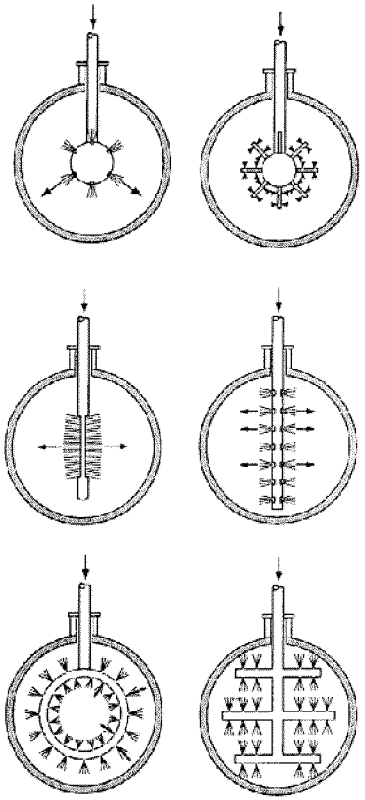
FIG. 3B are diagrams of gas distributors suitable for use in the gaseous oxidant dissolving system herein.

The mixing zone in the herein processes can be a suitable apparatus that achieves the necessary intimate mixing of the substantially liquid feedstock and gas so that sufficient gaseous oxidant is dissolved in the hydrocarbon feedstock. In other embodiments, the mixing zone can include a combined inlet for the gaseous oxidant and the feedstock. Effective unit operations include one or more gas-liquid distributor vessels, which apparatuses can include spargers, injection nozzles, or other devices that impart sufficient velocity to inject the gaseous oxidant into the liquid hydrocarbon with turbulent mixing and thereby promote gas saturation into the feed. Suitable apparatus are described with respect to FIGS. 3A and 3B herein.

Figure 3A:
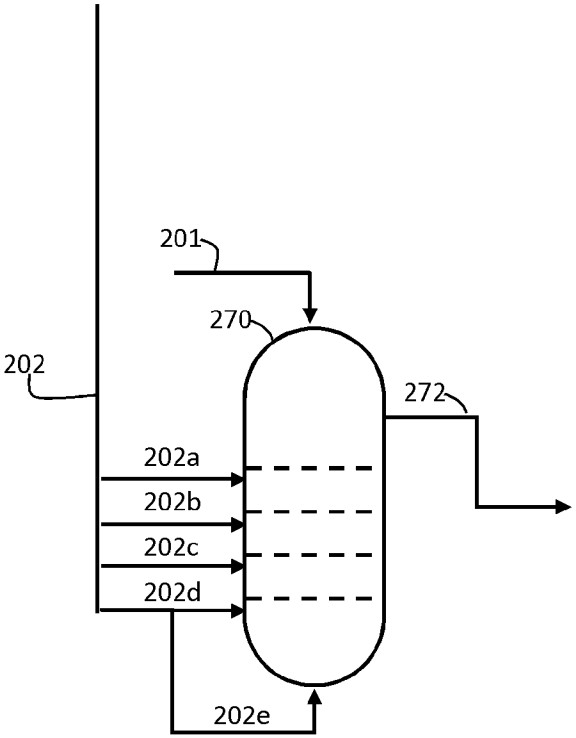
FIG. 3A is a schematic diagram of a gaseous oxidant dissolving system compatible with the method and apparatus of FIGS. 1 and 2.

In certain embodiments, such as, for example, shown in FIG. 3A, a column is used as a gas distributor vessel 270, in which gaseous oxidant 202 is injected at plural locations 202*a*, 202*b*, 202*c*, 202*d* and 202*e*. Gaseous oxidant is injected thru distributors into the column for adequate mixing to effectively dissolve gaseous oxidant in the feedstock. For instance, suitable injection nozzles can be provided proximate several plates (locations 202*a*-202*d*) and also at the bottom of the column (location 202*e*). The feedstock 201 (or combination of feedstock and peroxide precursor, as in the embodiment of FIG. 2) can be fed from the bottom or top of the column. The effluent 272 is the oxidant-enhanced feedstock (or combination of feedstock and peroxide precursor as in the embodiment of FIG. 2).

Various types of distributor apparatus can be used. For instance, referring to FIG. 3B, gas distributors can include tubular injectors fitted with nozzles and/or jets that are configured to uniformly distribute gaseous oxidant into the flowing hydrocarbon feedstock in a column or vessel in order to achieve a saturation state in the mixing zone.

The hydrocarbon stream that is subjected to oxidative desulfurization can be derived from naturally occurring fossil fuels such as crude oil, bitumens, biofuel, shale oils, coal liquids, intermediate refinery products or their distillation fractions such as naphtha, gas oil, vacuum gas oil or vacuum residue or combination thereof. A suitable feedstock can be any hydrocarbon mixture having boiling points ranging from about 36° C. to about 2000° C., although one of ordinary skill in the art will appreciated that certain other hydrocarbon streams can benefit from the practice of the system and method of the present invention.

Using the mixing zone and flashing zone described herein, a functionally effective amount of gaseous oxidant can be dissolved in the hydrocarbon feedstock (or combination of feedstock and peroxide precursor, as in the embodiment of FIG. 2). The amount of gaseous oxidant dissolved in the feedstock depends on various factors, including the operating conditions of the mixing zone and the flashing zone, and the boiling point of the feed.

In general, the operating conditions for the mixing zone in processes described herein includes a pressure in the range of from about 1-100 bar, in certain embodiments from about 1-50 bar, and in further embodiments from about 1-30 bar; a temperature in the range of from about 20° C.-400° C., in certain embodiments from about 20° C.-300° C., and in further embodiments from about 20° C.-200° C.; a residence time of from about 0.1-30 minutes, in certain embodiments from about 0.1-15 minutes, and in further embodiments from about 0.1-5 minutes; and an oxidant ($O_2$) to sulfur molar ratio of from about 1:1-100:1, in certain embodiments from about 1:1-30:1, and in further embodiments from about 1:1-5:1.

In certain embodiments in which heterogeneous catalyst is used, the oxidative desulfurization reaction zone can be a suitable liquid-solid reaction zone known to those skilled in the art. For instance, the reaction zone can include one or more reactors, such as fixed-bed reactors, ebullated bed reactors, slurry bed reactors, moving bed reactors, continuous stirred tank reactor, and/or tubular reactors. A fixed bed reactor can also comprise a plurality of catalyst beds.

The oxidation catalyst can be selected from one or more heterogeneous catalysts having metals from Group VB to Group VIIIB of the Periodic Table, including those selected from of Mn, Co, Fe, Cr and Mo. Suitable catalyst materials comprise at least one oxide of general formula $M_xO_y$ as defined above, and element M is preferably selected from the group that consists of titanium, zirconium, vanadium, chromium, molybdenum and tungsten. Molybdenum oxide $MoO_3$, vanadium oxide $V_2O_5$ and zirconium oxide $ZrO_2$, taken either separately or in a mixture, can be useful. The catalyst material can be provided in the form of powder, balls or extrudates.

Certain embodiments described herein for instance using a heterogeneous catalyst system, enable a range of applications for the present process. For instance, the herein described process can be carried out on skid mounted units, e.g., at terminals, pipelines, garages, forecourts, or on board fuel cell containing vehicles where sulfur sensitive hydrocarbon reformers and fuel cells are employed.

In certain embodiments, the catalyst can be a suitable homogeneous oxidative desulfurization catalyst, which is mixed with the feedstock, such as oxides and/or organo metal complexes of copper, zinc, cerium, cobalt, tungsten, nickel, vanadium, molybdenum, platinum, palladium, iron and mixtures thereof.

In general, the operating conditions in the oxidation reaction zone in the processes described herein includes a pressure in the range of from about 1-100 bar, in certain embodiments from about 1-50 bar, and in further embodiments from about 1-30 bar; a temperature in the range of from about 20° C.-400° C., in certain embodiments from about 20° C.-300° C., and in further embodiments from about 20° C.-200° C.; a residence time of from about 5-180 minutes, in certain embodiments from about 15-90 minutes, and in further embodiments from about 15-30 minutes; and an oxidant ($O_2$) to sulfur molar ratio of from about 1:1-100:1, in certain embodiments from about 1:1-30:1, and in further embodiments from about 1:1-5:1.

Operating conditions for the flash vessel in processes described herein includes a pressure in the range of from about 1-100 bar, in certain embodiments from about 1-50 bar, and in further embodiments from about 1-30 bar; a temperature in the range of from about 20° C.-400° C., in certain embodiments from about 20° C.-150° C., and in further embodiments from about 20° C.-200° C.; a residence time of from about 5-180 minutes, in certain embodiments from about 15-90 minutes, and in further embodiments from about 30-30 minutes; and an oxidant to sulfur molar ratio of from about 1:1-100:1, in certain embodiments from about 1:1-30:1, and in further embodiments from about 1:1-5:1.

Operating conditions for the in-situ peroxide generation vessel in the process described herein with respect to FIG. 2 includes a pressure in the range of from about 1-100 bar, in certain embodiments from about 1-50 bar, and in further embodiments from about 1-30 bar; a temperature in the range of from about 20° C.-300° C., in certain embodiments from about 20° C.-150° C., and in further embodiments from about 35° C.-60° C.; a residence time of from about 5-180 minutes, in certain embodiments from about 15-90 minutes, and in further embodiments from about 30-60 minutes; and an oxidant to sulfur molar ratio of from about 1:1-100:1, in certain embodiments from about 1:1-30:1, and in further embodiments from about 1:1-4:1.

The product separation zone for removal of sulfoxides and sulfones can be a suitable unit operation or series of unit operations known for this purpose, e.g., one or more extraction and/or adsorption unit operations.

According to the processes and systems herein, oxygen and liquid hydrocarbons are contacted in a vessel at relatively high pressure and then the gases are flashed off in a flash drum, whereby the oxygen containing liquid is sent to a suitable reactor for oxidative desulfurization, with an important aspect being the elimination or minimization of the gas phase. Thus, in a reaction zone using heterogeneous catalyst, a substantially two-phase system is provided, which comprises a solid catalyst phase and a liquid phase in the form of the hydrocarbon and the dissolved oxygen in liquid.

These systems and processes can eliminate the use of three phase reactors in oxidative desulfurization by mixing the gaseous oxidant with hydrocarbon liquid in a mixing vessel at a determined pressure and temperature and then flashing off the gas phase. Only dissolved oxygen in the liquid phase, which is sufficient for the reactions, is passed to the oxidation reactor (or in-situ peroxide generation vessel in the embodiment of FIG. 2).

Gas solubility is a function of hydrocarbon type, pressure and temperature. Hydrocarbons have certain capacity to absorb or dissolve the gaseous oxidant. To increase the concentration of the dissolved gaseous oxidant, the oxidation reactor effluents or desulfurized hydrocarbons after the separation steps can be recycled back to the reactor as a diluent.

Therefore, with the systems and processes herein, use of three phase reactors is eliminated and gaseous oxygen (oxygen, air, oxides of nitrogen) required for the oxidative desulfurization is available in solution. The oil/oxygen solution (and in certain embodiments, diluents, e.g., in the form of desulfurized hydrocarbons from the product separation zone)_ can then be fed to a suitable reactor within which the oil and oxygen react. No additional oxidant in gas phase is required and accordingly oxygen recirculation is avoided. Hence, conventionally large reactors can be replaced by much smaller or simpler reactors. In addition to using much smaller or simpler reactors, the use of gas phase oxygen recycle compressors can be avoided. Because all of the oxygen required for the reaction may be available in solution ahead of the reactor there is no need to circulate oxygen gas within the reactor and no need for the recycle compressor. Elimination of the recycle compressor and the use of, for example plug flow or tubular reactors, greatly reduces the capital cost of the oxidative process.

EXAMPLE

Oxygen in Hydrocarbon Solution

Figure 4:
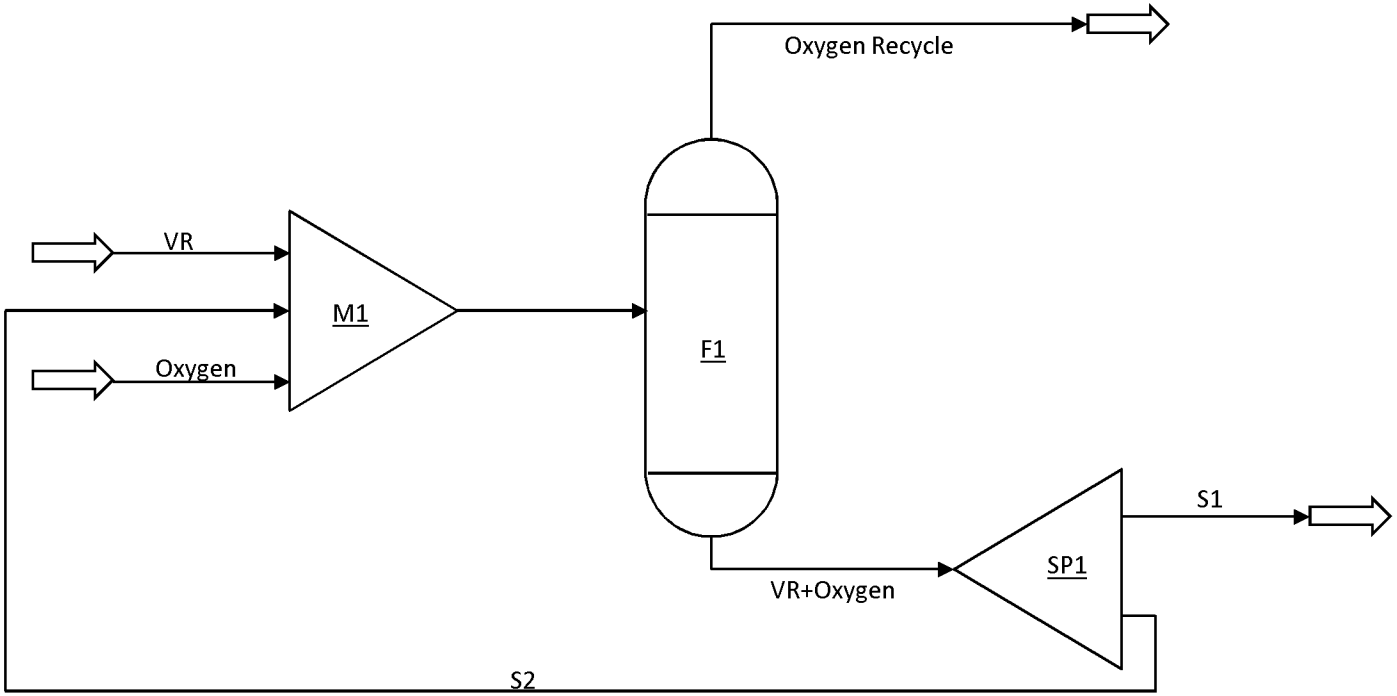
FIG. 4 is a process flow diagram of a system used in an example herein.

Oxygen solubility of a diesel oil with density of 0.8346 Kg/lt and sulfur content of 500 ppmw was calculated using PROII simulation software licensed by Invensys System Inc. A flow diagram is shown in FIG. 4. The distillation data for the diesel oil is given in Table 3.

TABLE 3

| ASTM D86 Distillation | |
|---|---|
| W % Off | Temperature, ° C. |
| IBP | 182 |
| 5% | 198 |

TABLE 3-continued

| ASTM D86 Distillation | |
|---|---|
| W % Off | Temperature, ° C. |
| 10% | 209 |
| 30% | 236 |
| 50% | 265 |
| 70% | 295 |
| 90% | 333 |
| 95% | 341 |
| EBP | 352 |

Table 4 shows the solubility of oxygen (mol %) in diesel oil as a function of temperature and pressure:

TABLE 4

| Solubility of Oxygen in Diesel Oil | | | | |
|---|---|---|---|---|
| | Mol % of oxygen in Diesel oil Temperature | | | |
| Pressure, bar | 100° C. | 200° C. | 300° C. | 350° C. |
| 1 | 0.002 | 0.002 | NA | NA |
| 10 | 0.017 | 0.018 | NA | NA |
| 20 | 0.034 | 0.037 | 0.043 | NA |
| 30 | 0.050 | 0.055 | 0.065 | NA |
| 40 | 0.066 | 0.072 | 0.087 | 0.097 |
| 50 | 0.081 | 0.090 | 0.108 | 0.122 |
| 80 | 0.124 | 0.138 | 0.169 | 0.192 |
| 100 | 0.150 | 0.168 | 0.207 | 0.236 |
| 150 | 0.210 | 0.238 | 0.292 | 0.334 |
| 200 | 0.263 | 0.298 | 0.366 | 0.418 |

NA-all in vapor phase.

The same diesel was subjected to oxidative desulfurization. 500 ppmw sulfur requires 0.003 mol % of oxygen in solution for full oxidation of sulfur compounds. This requires 2.35 bars of oxygen partial pressure. The reactions were simulated carried-out at 10 bars to supply excess oxidant, which was 0.017 mol % at 100° C., to the reactions.

Table 5 shows molar fractions and rate of different streams in the exemplary process.

TABLE 5

| Stream Name | | VR | OXYGEN | O2RECYCLE | VR + OXYGEN |
|---|---|---|---|---|---|
| Stream Description | | | | | |
| Phase | | Liquid | Vapor | Vapor | Liquid |
| Temperature | C. | 400.000 | 90.000 | 200.000 | 200.000 |
| Pressure | KG/CM2 | 10.000 | 10.000 | 50.000 | 50.000 |
| Total Molar Rate | KG-MOL/HR | 1.936 | 35.636 | 35.421 | 3.293 |
| Total Mass Rate | KG/HR | 1000.001 | 1141.912 | 1134.374 | 1507.538 |
| Molar Fractions | | | | | |
| O2 | | 0.000 | 1.000 | 1.000 | 0.122 |
| HXDECANE | | 0.000 | 0.000 | 0.000 | 0.000 |
| NBP 329 | | 0.001 | 0.000 | 0.000 | 0.001 |
| NBP 337 | | 0.033 | 0.000 | 0.000 | 0.029 |
| NBP 351 | | 0.031 | 0.000 | 0.000 | 0.027 |
| NBP 365 | | 0.045 | 0.000 | 0.000 | 0.039 |
| NBP 378 | | 0.070 | 0.000 | 0.000 | 0.061 |
| NBP 392 | | 0.062 | 0.000 | 0.000 | 0.054 |
| NBP 406 | | 0.060 | 0.000 | 0.000 | 0.053 |
| NBP 419 | | 0.061 | 0.000 | 0.000 | 0.054 |
| NBP 440 | | 0.112 | 0.000 | 0.000 | 0.093 |
| NBP 468 | | 0.126 | 0.000 | 0.000 | 0.111 |
| NBP 496 | | 0.120 | 0.000 | 0.000 | 0.105 |
| NBP 523 | | 0.109 | 0.000 | 0.000 | 0.096 |
| NBP 551 | | 0.101 | 0.000 | 0.000 | 0.088 |

TABLE 5-continued

| Stream Name | VR | OXYGEN | O2RECYCLE | VR + OXYGEN |
|---|---|---|---|---|
| NBP 575 | 0.047 | 0.000 | 0.000 | 0.041 |
| NBP 603 | 0.022 | 0.000 | 0.000 | 0.020 |
| Weight Fractions | | | | |
| O2 | 0.0000 | 1.0000 | 0.9991 | 0.0085 |
| HXDECANE | 0.0000 | 0.0000 | 0.0000 | 0.0000 |
| NBP 329 | 0.0006 | 0.0000 | 0.0000 | 0.0006 |
| NBP 337 | 0.0200 | 0.0000 | 0.0002 | 0.0196 |
| NBP 351 | 0.0202 | 0.0000 | 0.0001 | 0.0199 |
| NBP 365 | 0.0307 | 0.0000 | 0.0001 | 0.0303 |
| NBP 378 | 0.0499 | 0.0000 | 0.0002 | 0.0494 |
| NBP 392 | 0.0466 | 0.0000 | 0.0001 | 0.0461 |
| NBP 406 | 0.0483 | 0.0000 | 0.0001 | 0.0479 |
| NBP 419 | 0.0516 | 0.0000 | 0.0000 | 0.0512 |
| NBP 440 | 0.1032 | 0.0000 | 0.0000 | 0.1023 |
| NBP 468 | 0.1285 | 0.0000 | 0.0000 | 0.1275 |
| NBP 496 | 0.1338 | 0.0000 | 0.0000 | 0.1328 |
| NBP 523 | 0.1330 | 0.0000 | 0.0000 | 0.1320 |
| NBP 551 | 0.1330 | 0.0000 | 0.0000 | 0.1320 |
| NBP 575 | 0.0665 | 0.0000 | 0.0000 | 0.0660 |
| NBP 603 | 0.0342 | 0.0000 | 0.0000 | 0.0340 |
| Liquid Weight Fraction | 1.0000 | 0.0000 | 0.0000 | 1.0000 |
| Total Molecular Weight | 516.604 | 31.999 | 32.025 | 457.831 |

The method and system of the present invention have been described above and in the attached drawings; however, modifications will be apparent to those of ordinary skill in the art and the scope of protection for the invention is to be defined by the claims that follow.

The invention claimed is:

1. An oxidative desulfurization process comprising:

a. mixing a hydrocarbon feedstock containing hetero-aromatic sulfides benzothiopenes, and dibenzothiopenes, and an excess of gaseous oxidant in a mixing zone under predetermined conditions of temperature and pressure to dissolve a portion of the gaseous oxidant in the hydrocarbon feedstock to produce a mixture of an undissolved gaseous oxidant portion and a liquid phase portion of gaseous oxidant-enriched hydrocarbon feedstock;

b. passing the mixture from step (a) to a flashing zone;

c. in the flashing zone, flashing light hydrocarbon compounds and undissolved gaseous oxidant from the liquid phase gaseous oxidant-enriched hydrocarbon feedstock; and d. from the flashing zone, passing the liquid phase gaseous oxidant-enriched hydrocarbon feedstock to an oxidation reaction zone, and maintaining the gaseous oxidant-enriched hydrocarbon feedstock in the oxidation reaction zone under conditions effective to oxidize hetero-aromatic sulfides into corresponding hetero-aromatic sulfoxides and/or sulfones.

2. The process of claim 1, wherein a mixture of hydrocarbons and hetero-aromatic sulfoxides and/or sulfones is produced, further comprising e. separating hetero-aromatic sulfoxides and/or sulfones from the mixture of hydrocarbons and hetero-aromatic sulfoxides and/or sulfones; and f. recovering a hydrocarbon product having reduced concentration of hetero-aromatic sulfides.

3. The process of claim 2, further comprising g. recycling a portion of hydrocarbon product from step (f) to step (a) as diluent.

4. The process of claim 1, wherein undissolved gaseous oxidant is recycled to the mixing zone.

5. The process of claim 1, wherein steps (a)-(d) occur at a pressure of between 1 bar and 100 bar.

6. The process of claim 1, wherein steps (a)-(d) occur at a pressure of between 1 bar and 50 bar.

7. The process of claim 1, wherein steps (a)-(d) occur at a pressure of between 1 bar and 30 bar.

8. The process of claim 1, wherein step (d) occurs in the presence of heterogeneous catalyst and the oxidation reaction zone operates in substantially solid-liquid phase.

9. The process of claim 1, wherein step (d) occurs in the presence of homogeneous catalyst and the oxidation reaction zone operates in substantially liquid phase.

10. An oxidative desulfurization process comprising:

a. mixing a hydrocarbon feedstock containing hetero-aromatic sulfides benzothiopenes, and dibenzothiopenes, peroxide precursor, and an excess of gaseous oxidant in a mixing zone under predetermined conditions of temperature and pressure to dissolve a portion of the gaseous oxidant in the hydrocarbon feedstock to produce a mixture of an undissolved gaseous oxidant portion and a liquid phase portion of gaseous oxidant-enriched hydrocarbon feedstock;

b. passing the mixture from step (a) to a flashing zone;

c. in the flashing zone, flashing light hydrocarbon compounds and undissolved gaseous oxidant from the liquid phase gaseous oxidant-enriched hydrocarbon feedstock containing peroxide precursor;

d. from the flashing zone, passing the liquid phase gaseous oxidant-enriched hydrocarbon feedstock containing peroxide precursor to an oxidation reaction zone, and maintaining the gaseous oxidant-enriched hydrocarbon feedstock containing peroxide precursor under conditions effective to form peroxide oxidant; and e. maintaining the peroxide oxidant formed in step (d) with remaining original feed and optionally additional feed under conditions to oxidize hetero-aromatic sulfides into corresponding hetero-aromatic sulfoxides and/or sulfones.

11. The process of claim 10, wherein a mixture of hydrocarbons and hetero-aromatic sulfoxides and/or sulfones is produced, further comprising f. separating hetero-aromatic sulfoxides and/or sulfones from the mixture of hydrocarbons and hetero-aromatic sulfoxides and/or sulfones; and g. recovering a hydrocarbon product having reduced concentration of hetero-aromatic sulfides.

12. The process of claim 11, further comprising h. recycling a portion of hydrocarbon product from step (g) to step (a) as diluent.

13. The process of claim 10, wherein undissolved gaseous oxidant is recycled to the mixing zone.

14. The process of claim 10, wherein steps (a)-(e) occur at a pressure of between 1 bar and 100 bar.

15. The process of claim 10, wherein steps (a)-(e) occur at a pressure of between 1 bar and 50 bar.

16. The process of claim 10, wherein steps (a)-(e) occur at a pressure of between 1 bar and 30 bar.

17. The process of claim 10, wherein step (d) occurs in the presence of heterogeneous catalyst and the oxidation reaction zone operates in substantially solid-liquid phase.

18. The process of claim 10, wherein step (d) occurs in the presence of homogeneous catalyst and the oxidation reaction zone operates in substantially liquid phase.

19. The process of claim 1, wherein the mixing zone is one or more gas-liquid distributor vessels with integrated spargers, injection nozzles, or other devices that impart sufficient velocity to inject the gaseous oxidant into the hydrocarbon feedstock with turbulent mixing and thereby promote saturation of the gaseous oxidant into the hydrocarbon feedstock.

20. The process of claim 10, wherein the mixing zone is one or more gas-liquid distributor vessels with integrated spargers, injection nozzles, or other devices that impart sufficient velocity to inject the gaseous oxidant into the hydrocarbon feedstock with turbulent mixing and thereby promote saturation of the gaseous oxidant into the hydrocarbon feedstock.

* * * * *